US005386767A

United States Patent [19]

Edinburgh

[11] Patent Number: 5,386,767

[45] Date of Patent: Feb. 7, 1995

[54] AUTOMATIC CONTROLLER FOR COTTON MODULE BUILDERS

[76] Inventor: James K. Edinburgh, 327 S. Ivy, Crosbyton, Tex. 79322

[21] Appl. No.: 128,248

[22] Filed: Sep. 29, 1993

[51] Int. Cl.[6] ..... B30B 15/16

[52] U.S. Cl. ..... 100/48; 100/226

[58] Field of Search ..... 100/48, 100, 226

[56] References Cited

U.S. PATENT DOCUMENTS

| | | | |
|---|---|---|---|
| 2,606,610 | 8/1952 | Collier . | |
| 3,603,244 | 9/1971 | Jureit et al. | 100/100 X |
| 3,866,530 | 2/1975 | Moehlenpah | 100/100 X |
| 4,184,425 | 1/1980 | Haney et al. | 100/100 |
| 4,278,016 | 7/1981 | Haney et al. | 100/226 X |
| 4,716,825 | 1/1988 | Lemmond | 100/100 X |
| 5,042,363 | 8/1991 | Eriksson et al. | 91/391 A |
| 5,167,185 | 12/1992 | Bass, III | 100/226 |

FOREIGN PATENT DOCUMENTS

| | | | |
|---|---|---|---|
| 2754159 | 6/1978 | Germany | 100/226 |
| 395061 | 1/1974 | U.S.S.R. | 100/226 |

*Primary Examiner*—Stephen F. Gerrity
*Attorney, Agent, or Firm*—Richard C. Litman

[57] ABSTRACT

An automatic control for a cotton module builder controls the traversing motor which moves the tamping mechanism in a horizontal direction atop the cotton module builder as well as the packing cylinder which moves a tamping platen up and down. The automatic controller operates continuously in predetermined cycles having adjustable durations. In a first portion of each predetermined cycle the tamping platen is moved up. In a second portion of each predetermined cycle the tamping platen is moved down to compress any cotton within the bin of the cotton module builder located directly below the tamping mechanism. In an overlap portion located about a transition between the first and second portions of each predetermined cycle, the traversing motor is activated to move the tamping mechanism in a predetermined direction for a predetermined distance so as to place the tamping platen over another portion of the bin.

11 Claims, 4 Drawing Sheets

AUTOMATIC CONTROLLER FOR COTTON MODULE BUILDERS

BACKGROUND OF THE INVENTION

1. Field of the Invention

The present invention relates to hydraulic controllers of cotton module builders. More particular, the present invention relates to a controller connectable to the hydraulic controls of an existing cotton module builder to automatically perform the tasks of operating the control valves to both the packing cylinder and the traversing motor.

2. Description of the Prior Art

Conventional module builders include a bin with an open top having a track or rail on each side along the length of the open top. A tamper travels along the top of the bin under the power of a hydraulic motor. In order to pack the cotton contained in the bin, an operator moves the tamper over a portion of the bin and operates a press to push down on the cotton over that particular portion. Afterwards the tamper is moved to another location and the process is repeated. Several passes are made as cotton is placed in the bin.

U.S. Pat. No. 4,184,425 issued Jan. 22, 1980 to Donald J. Haney et al discloses a self-propelled cotton module builder. An operator has a seat located on a raised platform which allows the operator to observe the entire bin. A control panel allows the operator to control the tamping mechanism as well as other operations of the self-propelled cotton module builder.

U.S. Pat. No. 4,278,016 issued Jul. 14, 1981 to Donald J. Haney et al discloses a cotton module builder having the operator seated on a platform located in the middle of one side of the bin. The module builder has a tamping mechanism mounted on rails and attached to an endless chain driven by a reversible motor. A hydraulic packing cylinder is used to operate a tamping platen.

U.S. Pat. No. 5,167,185 issued Dec. 1, 1992 to B. Hampton Bass, III discloses a cotton module builder utilizing a tamping mechanism mounted on a pair of I-beams. Hydraulic motors located on the bridge move the tamping mechanism horizontally along the open top of the bin. A hydraulic cylinder is used to move the tamping platen up and down.

U.S. Pat. No. 2,606,610 issued Aug. 12, 1952 to Richard Collier discloses a controller for an hydraulic press to automatically control the opening and closing of dies used in a molding process.

U.S. Pat. No. 5,042,363 issued Aug. 27, 1991 to Lars P. Eriksson discloses a device for effecting both remote and direct control of a hydraulic directional valve.

None of the above inventions and patents, taken either singly or in combination, is seen to describe the instant invention as claimed.

SUMMARY OF THE INVENTION

The present invention relates to a controller for operating the tamping mechanism of a cotton module builder having manual controls for the operation thereof. In this manner, the operator is no longer needed to move the tamping mechanism back and forth along the length of the bin while operating the tamping platen to compress cotton.

Accordingly, it is a principal object of the invention to provide a device which will eliminate the need of having an operator control the tamping mechanism of a cotton module builder.

It is another object of the invention to such a device which is attachable to the manual controls of an existing cotton module builder.

It is a further object of the invention to allow manual control of the tamping mechanism when the device of the present invention is not being operated.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
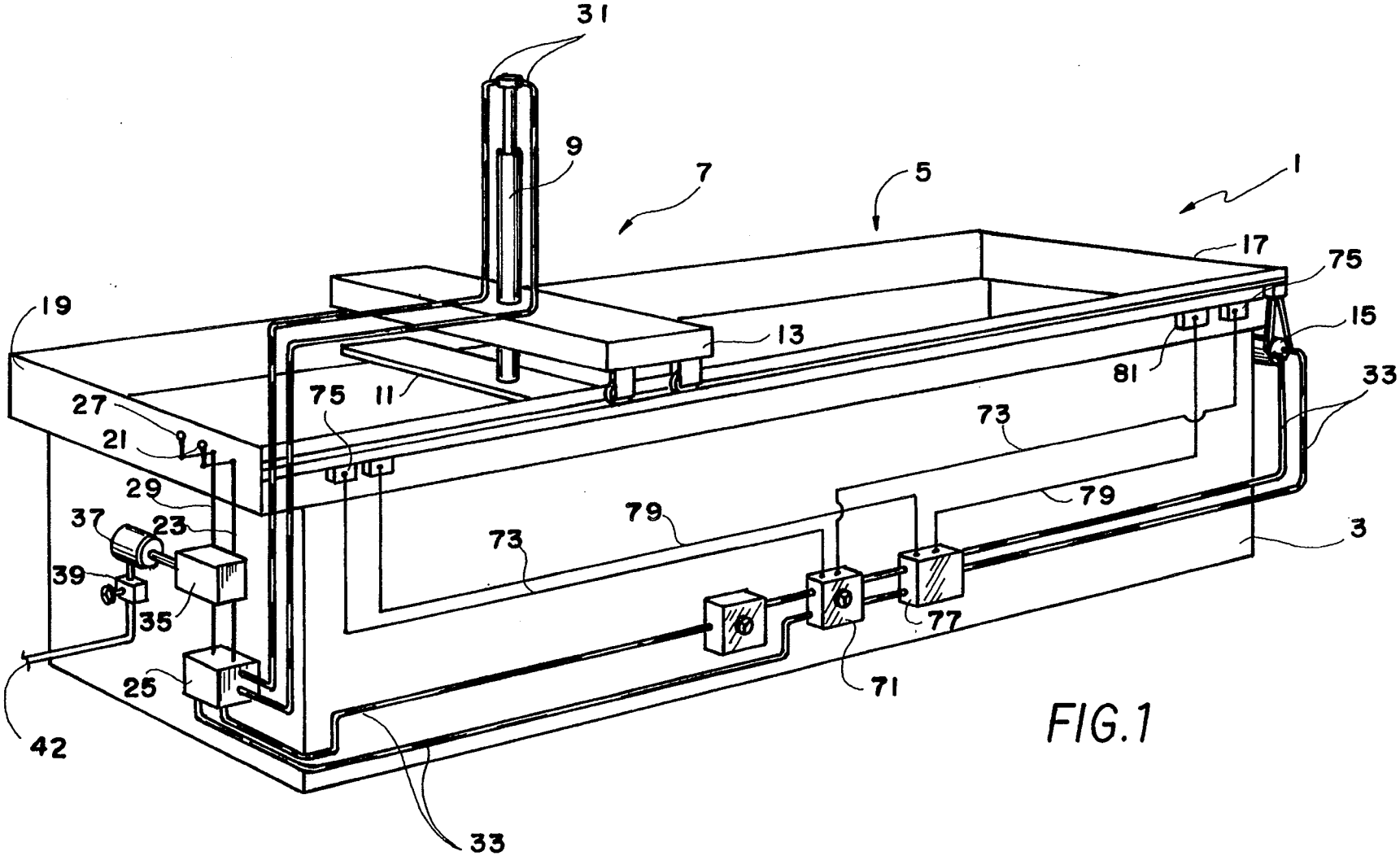
FIG. 1 is a perspective side view of the first embodiment of the present invention.

FIG. 1 illustrates a cotton module builder 1 utilizing the device of the present invention. The cotton module builder 1 includes a bin 3 for containing cotton deposited therein through a top open end 5. A tamping mechanism 7 mounted above the top open end 5 includes a hydraulically driven packing cylinder 9 for moving a tamping platen 11 vertically in either a downward direction toward any cotton contained within the bin 3 located directly below the tamping platen 11 or upward direction back to the top open end 5. In this manner any cotton located directly below the tamping platen 11 is beaten down and compressed. A platform 13, attached to the packing cylinder 9, moves horizontally along the top open end 5 to allow horizontal traversal of the tamping platen 11.

A hydraulically driven traversing motor 15 is used to provide the horizontal movement of the platform 13 either in a forward direction toward one end 17 of the bin 3 or in a reverse direction toward another end 19. A human operator controls the operation of the traversing motor 15 through the use of a first handle 21 connected to a first lever 23 for controlling control valves 25. This human operator also controls the operation of the packing cylinder 9 through the use of a second handle 27 connected to a second lever 29 for controlling control valves 25. The control valves 25 are used to supply hydraulic power to the packing cylinder 9 through a pair of fluid conduits 31 and to the traversing motor 15 through fluid conduits 33. The use of control valves 25 in controlling the horizontal and vertical movement of the tamping mechanism 7 is conventional in prior cotton module builders such as described in U.S. Pat. No. 4,278,016 issued to Donald J. Haney et al and U.S. Pat.

No. 5,167,185 issued to B. Hampton Bass, III, incorporated herein by reference.

Figure 2:
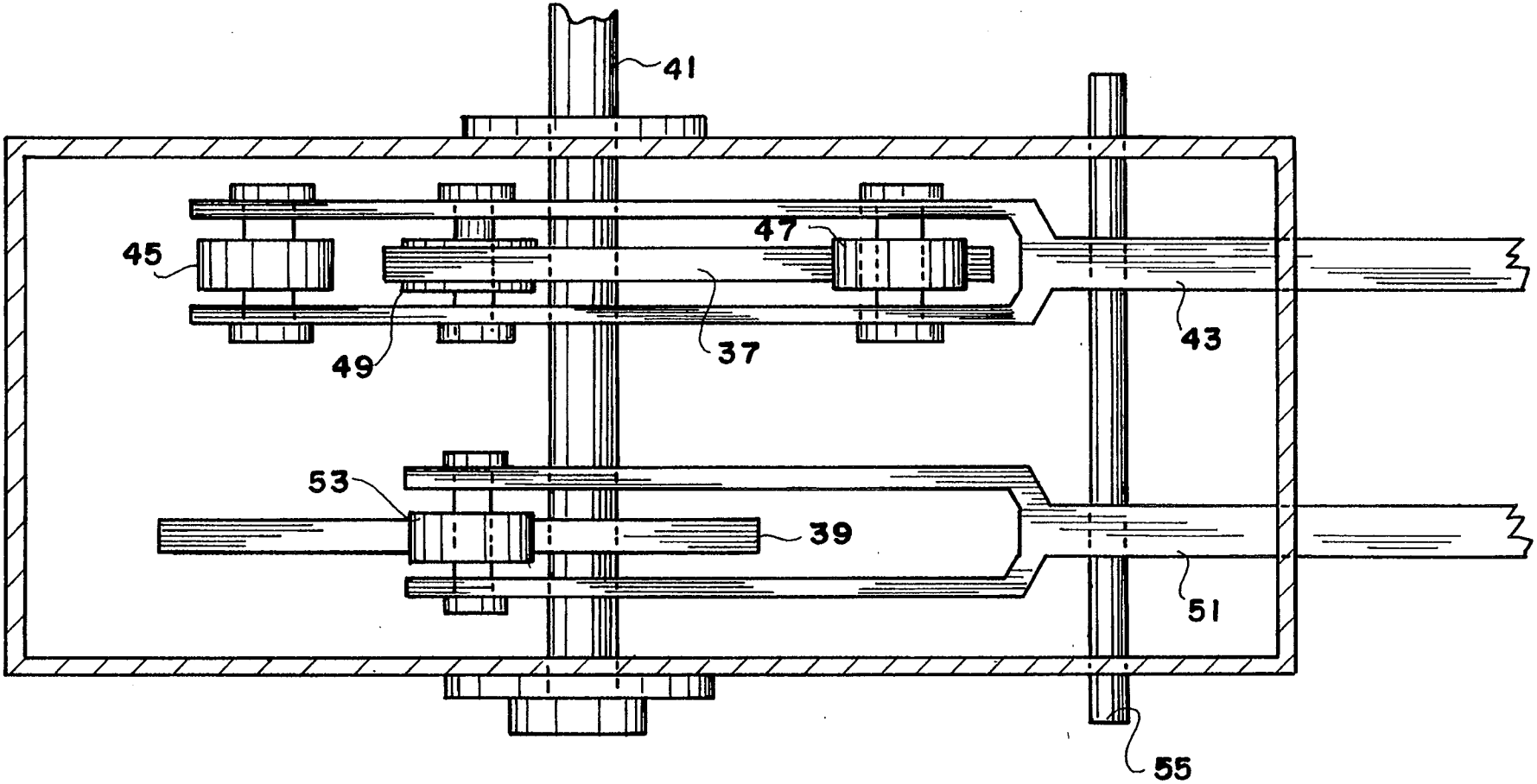
FIG. 2 is a top cut-away view of the controller cam housing of the first embodiment of the present invention.

AS shown in FIG. 1, a cam housing 35 is used to automatically control the levers 23 and 29. As shown in FIG. 2, within the cam housing 35 is a packing cam 37 and a traversing cam 39 connected to a common cam shaft 41. A packing rocker arm 43 has rollers 45, 47, and 49 attached thereto for engaging the packing cam 37. A traversing rocker arm 51 has a roller 53 attached thereto for engaging the traversing cam 39. The packing rocker arm 43 and the traversing rocker arm 51 have pivotal connections through a pin 55.

Figure 3:
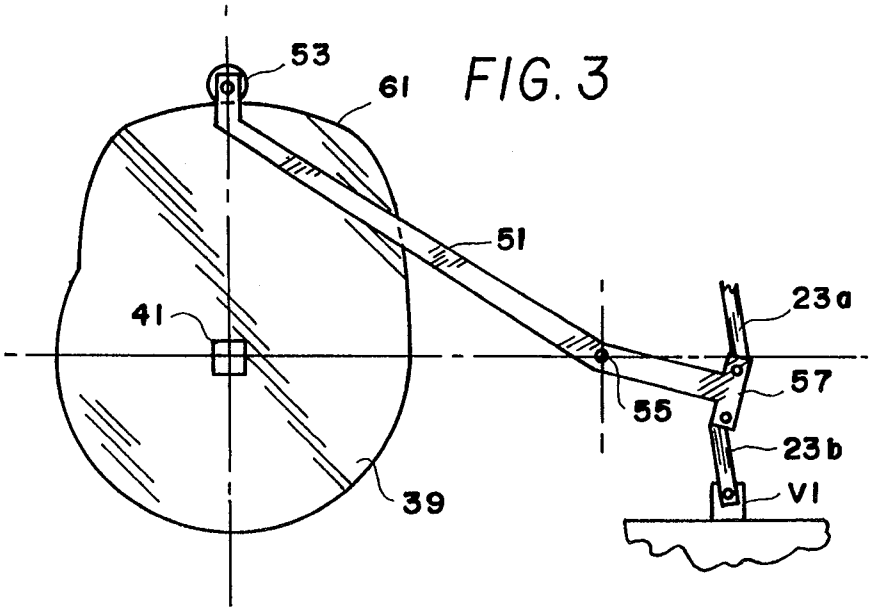
FIG. 3 is a cutaway view of the traversing cam mechanism of the first embodiment of the present invention.

As illustrated in FIG. 3, the first lever 23 is cut and pivotally attached to a traversing yoke 57. A top portion 23*a* of the lever 23 has a bottom end thereof pivotally attached to the top end of the yoke 57. A bottom portion 23*b* of the lever 23 has a top, end thereof pivotally attached to a bottom end of the yoke 57. The top portion 23*a* is a lever connected to the handle 21. The portion 23*b* forms a push rod which pushes down on the on a first control valve V1 of the control values 25 to supply hydraulic power to the traversing motor 15. The push rod 23*b* is pushed down as an engaging portion 61 of the traversing cam 39 located at a farthest most region from an axis of rotation about the cam shaft 41 pushes up on the roller 53, thereby pushing down on the end of the traversing rocker arm 51 connected to a middle portion of the traversing yoke 57 as the rocker arm 51 pivots about the pin 55.

Figure 4:
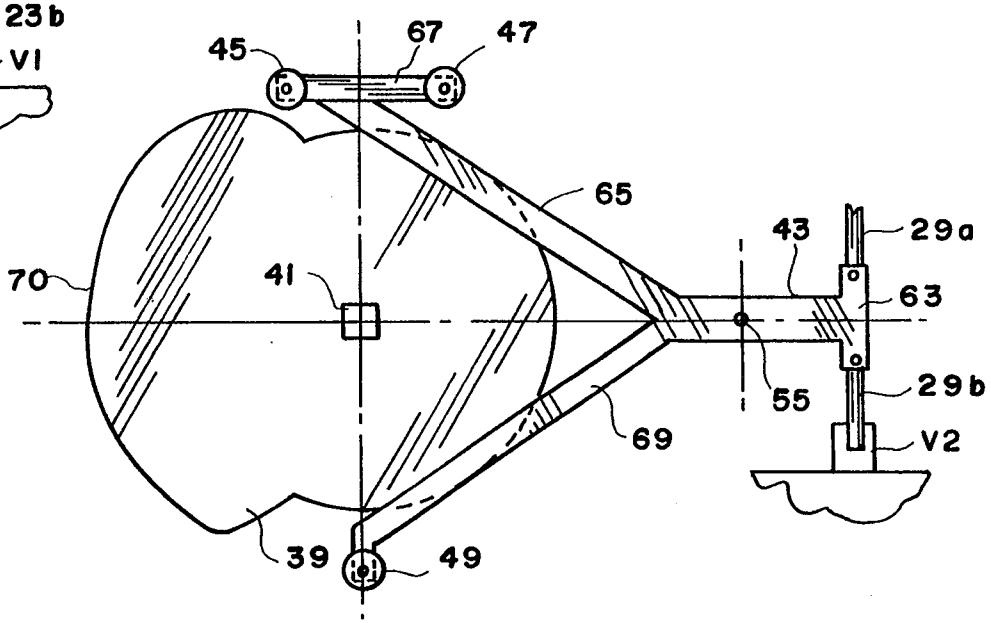
FIG. 4 is a cutaway view of the packing cam mechanism of the first embodiment of the present invention.

As illustrated in FIG. 4, the second lever 29 is cut and an upper portion 29*a* is pivotally attached to a top end of a packing yoke 63. A bottom portion 29*b* of the lever 29 is pivotally attached to a bottom end of the packing yoke 63. The bottom portion 29*b* is also pivotally attached to the packing control valve V2 of the control valve 25. The packing rocker arm 43 is attached to a middle portion of the packing yoke 63 at one end thereof. At the other end of the packing rocker arm is a first arm portion 65 extending upwardly therefrom so as to position a cross bar 67 to which the rollers 45 and 47 are attached above the packing cam 39. A second arm portion 69 extends down from the packing rocker arm so as to position the roller 49 (FIG. 2) below the packing cam 39.

As an engaging portion 70 located at a farthest most region of the packing cam 39 from an axis of rotation about the cam shaft 41 pushes up on either of the rollers 45 or 47, (FIG. 2) the cross bar 67 is pushed upwards so as to cause the rocker arm 43 to pivot about the pin 55, thereby pushing down on the lever portion 29*b* and the packing control valve V2. This provides hydraulic power to the packing cylinder 9 so as to push the tamping platen 11 in a downward direction. As the engaging portion 70 engages the roller 49, the second arm portion 69 is pushed downwards, thereby causing the packing rocker arm 43 to pivot about the pin 55 so as to rotate the packing yoke 63 in a direction pulling up on the lever portion 29*b* and the valve V2. This provides hydraulic power to the packing cylinder 9 so as to pull the tamping platen 11 in an upward direction.

The tamping platen 11 is pushed down whenever either of the two rollers 45 and 47 are in contact with the engaging portion 70 so as to push up on the first arm portion 65, and is pulled up only when the one roller 49 is in contact therewith, the tamping platen 11 is pushed down longer than it is pulled up for each cycle of the cam shaft 41. This is necessary since most packing cylinders designed for cotton module builders have larger packing pistons to push the tamping platen down then return pistons to pull the platen back up. In this manner, more downward pressure can be applied to compress the cotton. The only upward pressure necessary is to pull the cotton platen upwards.

As illustrated in FIG. 1, a hydraulically driven cam shaft motor 37 is used to drive the cam shaft 41 in a rotary direction at a predetermined angular velocity as set by a control valve 39. A hydraulic fluid conduit 42 is used to provide hydraulic fluid from the hydraulic pump (not illustrated) of the cotton module builder 1. This hydraulic pump is used to provide hydraulic power to all portions of the cotton module builder 1 needing the same, as is conventional in the prior art.

Each rotation of the cam shaft 41 provides one cycle of operation. The automatic controller of the present invention provides for a continuous operation of the cam shaft motor to provide continuous cycles of predetermined lengths as set by the control valve 39. The faster the cam shaft motor 37 is driven, the shorter the cycles. The cam arrangement within the housing 35 establishes specific portions of each cycle to cause the packing cylinder 9 to be pushed down, pulled up, or to cause the traversing motor 15 to operate. More specifically, in the preferred embodiment, a first portion of each cycle begins with the packing cylinder 9 being driven to pull up on the tamping platen 11. During a second portion of each cycle, the packing cylinder 9 pushes down on the tamping platen 11. As stated above, the first portion of each cycle (e.g., that portion in which the tamping platen is being driven upwards) is longer than the second portion thereof (e.g. that portion in which the tamping platen is being driven downward). Within an overlap portion located about a transition from said first and second portions of each cycle, the traversing motor is operated as discussed below in conjunction with FIG. 6.

As shown in FIG. 1, and as stated above, control valves 25 provide hydraulic power to both the packing cylinder 9 and the traversing motor 15. The control valves 25 receive hydraulic power from a hydraulic pump (not shown) found in conventional cotton module builders as disclosed by Haney et al. and B. Hampton Bass, III. The fluid conduit 42 is also supplied by this hydraulic pump. When either of the control valves V1 or V2 are depressed hydraulic fluid under pressure is allowed to flow in a particular direction within the fluid conduits 31 or 33, respectively. Whenever either of the valves V1 or V2 are pulled up, the hydraulic fluid flows in an opposite direction within the respective conduit 31 or 33. The operation described above for reversing the direction of hydraulic pressure supplied to the packing cylinder 9 and traversing motor 15 is conventional for most cotton module builders found.

In the present invention, the control valve V1 is pushed down to supply hydraulic power to conduits 33. As stated above, during an overlap portion between the first and second portions of each predetermined cycle of the operation of the automatic controller of the present invention, the traversing cam 39 engages the roller 53 so as to push down on the control valve V1. Hydraulic power is thus supplied from the control valve V1 to the traversing motor 15 in a predetermined direction. A fluid flow reversing switch 71 is used in the present invention to activate the traversing motor 15 in a predetermined mode by either allowing the fluid to flow in the same direction along the conduit 33 or by reversing the direction of flow going to the traversing motor. In this manner the tamping mechanism 7 can be driven in a forward mode toward a first end 17 of the bin 3 or in a reverse mode toward a second end 19 of the bin 3, depending on the setting of the fluid flow reversing switch 71.

As shown in FIG. 1, the fluid flow reversing switch 71 can be manually adjusted or, alternatively, automatically adjusted via a pair of control signals 73. The control signals 73 are generated from a pair of end detectors 75. When the tamping mechanism triggers one of the end detectors 75, that one of the detectors 75 generates one of the control signal 73. The setting of the fluid flow reversing switch 71 is changed in response to either of the control signal 73 being detected thereby. Therefore, upon receiving one of the control signals 73, the fluid flow reversing switch 71 changes the predetermined mode of the traversing motor 15 to a reverse mode if the tamping mechanism 7 reached the first end 17, or, alternatively, to the forward mode if the tamping mechanism 7 reached the second end 19.

An automatically controlled flow valve 77 is activated by a pair of control signals 79 generated by a pair of proximity end detectors 81 which detect when the tamping mechanism 7 is located near one of the ends 17 or 19. If the tamping mechanism 7 is located near one of the end 17 or 19, the appropriate one of the detectors 81 generates one of the control signals 79. In response thereto, the flow valve 77 is adjusted to restrict the fluid flow going to the traversing motor 15 in order to slow the tamping mechanism 7 down before its direction is reversed. When the tamping mechanism 7 no longer engages either one of the proximity end detectors 81, neither of the control signal 79 are generated and the flow valve allows the hydraulic fluid to flow therethrough at the same rate before valve 77 was restricted. A manually adjustable flow rate valve 83 is provided to allow the user to adjust the maximum speed of the traversing motor 15.

Figure 5:
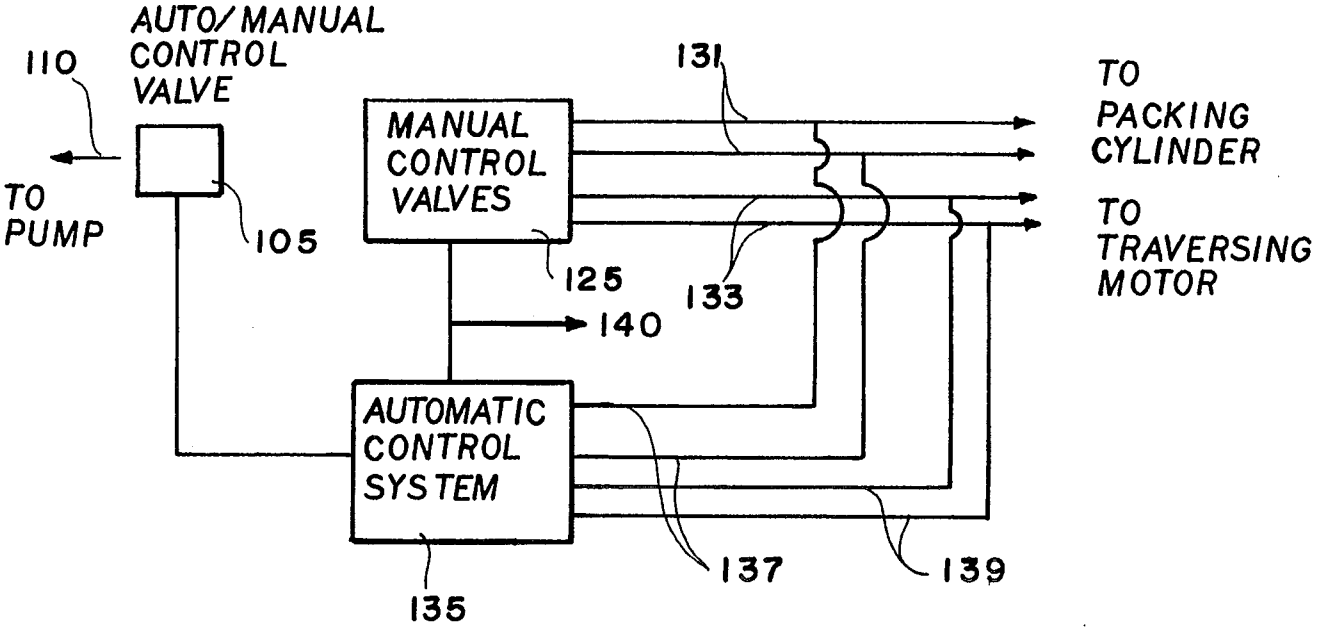
FIG. 5 is a block diagram view of the second embodiment of the present invention.

A second embodiment of the automatic control system 135 of the present invention is illustrated in FIG. 5. In this system, a separate set of control valves, other than the manually activated control valves 125, is provided for attachment to a control valve 105 inserted in the hydraulic line 110 from the hydraulic pump going to the manual control valves 125. In this manner, hydraulic power can be diverted to the automatic control system 135 when automatic control of the tamping mechanism is desired. A pair of conduits from a first valve (not shown) of the present invention is used to provide hydraulic power to the conduits 131 going to the packing cylinder. Likewise, a pair of conduits 139 is used to provide power to a pair conduits 133 going to the traversing motor of the cotton module builder device of the present invention is attached. In this manner, hydraulic power to either the packing cylinder or traversing motor may be provided by manual operation of the manual control valves 125 when the control valve 105 directs hydraulic fluid thereto from the hydraulic pump. Alternatively, an automatic operation of the tamping mechanism may be performed when hydraulic fluid is supplied to the automatic control system from the control valve 105. The control valve 105 is preferably manually operated.

Figure 6:
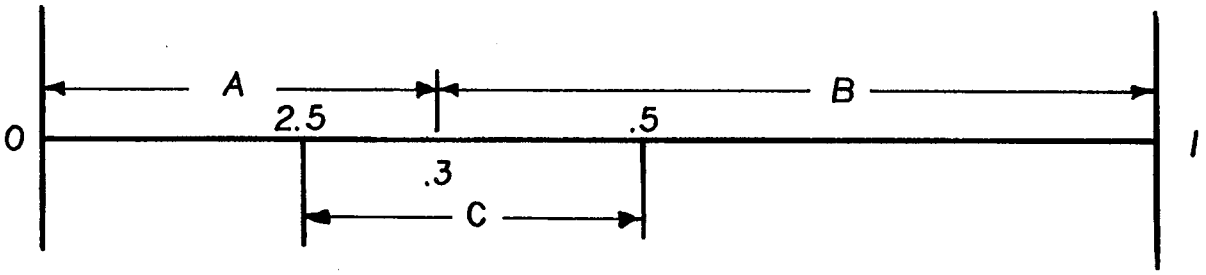
FIG. 6 is a timing diagram for the present invention.

FIG. 6 illustrates a preferred predetermined cycle of operation for a given period of operation. In the first embodiment, this period is set by controlling the speed of the cam shaft motor 37. In the second embodiment, this period could be controlled via digital inputs to a microprocessor or other electronic controller designed to control actuators, such as electrical relays. The actuators would then control the control valves, one of which supplies power in a given direction to the conduits 137 (FIG. 5) and the other to the conduits 139. Both actuators would have to be able to pull up on a respective control valve to supply hydraulic fluid in one direction and also push down on the respective control valve in order to supply hydraulic fluid in an opposite direction. In this manner, the packing cylinder can be pushed down as well as pulled up and the traversing motor can be driven in a forward mode as well as a reverse mode of operation. The tamping mechanism is thus controlled in the same way in both the first and second embodiments of the present invention in regard to the vertical and horizontal movement thereof.

As illustrated in FIG. 6, the first portion A of a predetermined cycle has a duration of a third of that cycle in which fluid is supplied to the packing cylinder in order to pull the tamping platen upwards as described in either the first or second embodiment above. During a second portion B of a predetermined cycle extending for the last two-thirds of the duration thereof, the packing cylinder is driven downwards. Note that if the tamping mechanism is driven to the cotton, the hydraulic pressure builds up to a maximum pressure allowed by the control valve, after which the control valve redirects the hydraulic fluid from the hydraulic pump to a reservoir from which the pump retrieves its hydraulic fluid. This occurs for all of the hydraulic valves, automatic and manual, used in the present invention. For example, in FIG. 5, the conduit 140 is a bleed line which allows hydraulic fluid from any of the four valves, two manual and two automatic, to flow therethrough once the maximum pressure is reached in any of the conduits 131, 133, 137, or 139.

As illustrated in FIG. 6, during an overlap portion C, the tamping mechanism is moved horizontally in a predetermined mode, e.g., either forward or backwards, after a quarter duration of the cycle is completed and for a duration until half the cycle is completed.

It is to be understood that the present invention is not limited to the sole embodiments described above, but encompasses any and all embodiments within the scope of the following claims.

I claim:

1. A cotton module builder comprising:

a bin for containing cotton deposited through a top open end thereof;

tamping means mounted on said top open end for performing a tamping function by compacting cotton contained within said bin, said tamping means including a tamping platen for performing said tamping function and a vertical drive means for selectively moving said tamping platen in a downward direction towards any cotton contained in said bin and in an upward direction away from any cotton contained in said bin;

horizontal drive means for allowing said tamping means to move horizontally along said top open end of said bin when activated in a predetermined mode, said predetermined mode selectively adjustable between a forward mode for moving said tamping means in a first horizontal direction toward a first end of said bin and a reverse mode for moving said tamping means in a second horizontal direction opposite said first horizontal direction toward a second end of said bin opposite said first end of said bin; and controller means for automatically and continuously operating said vertical drive means and said horizontal drive means in predetermined cycles.

2. A cotton module builder as claimed in claim 1, wherein said controller further comprises:

vertical drive actuation means for activating said vertical drive means so as to move said tamping platen in said upward direction for a first portion of each of said predetermined cycles and in said downward direction for a second portion of each of said predetermined cycles; and horizontal drive actuation means for activating said horizontal drive means in said predetermined mode for an overlap portion located about a transition between said first portion and said second portion of each predetermined cycle.

3. A cotton module builder as claimed in claim 2, wherein said horizontal drive means includes a hydraulic traversing motor, said horizontal drive actuation means comprising;

a first control valve for providing hydraulic power to said hydraulic traversing motor, thereby activating said horizontal drive means in said predetermined mode when said first control valve is placed in a lowered state, said first control valve preventing said tamping means from moving horizontally when placed in a neutral state;

a first push rod pivotally attached at a bottom end thereof to said first control valve;

a first manually activated lever for engaging said first push rod;

a first yoke pivotally attached at a top end thereof to a bottom end of said first manually activated lever and at a bottom end thereof to a top end of said first push rod;

a first rocker arm attached at a first end to a middle portion of said first yoke;

a first cam;

a first roller located above said first cam and attached at a second end of said first rocker arm;

a first rocker arm pivot located between said first and second ends of said first rocker arm;

a cam shaft connected to said first cam so as to rotate said first cam about a first axis of rotation of said first cam; and a motor for driving said cam shaft in a rotary direction at a predetermined angular velocity, wherein an engaging portion of said first cam located at a region furthest from said first axis of rotation pushes said first roller upwardly during said portion of each predetermined cycle so as to push said second end of said first rocker arm upwardly, thereby rotating said first rocker arm about said first rocker arm pivot so as to push said first end of said first rocker arm down, pushing said first yoke down so as to push said first push rod down, and placing said first control valve in said lowered state, thereby activating said horizontal drive means in said predetermined state.

4. A cotton module builder as claimed in claim 3, wherein said vertical drive means includes a hydraulic packing cylinder, said vertical drive actuation means comprising:

a second control valve for providing hydraulic power in a lowered state to said packing cylinder, thereby causing said tamping platen to move in said downward direction, said second control valve causing said tamping platen to move in said upwardly direction when placed in a raised state, and preventing said tamping platen from moving vertically when placed in a neutral state;

a second push rod pivotally attached at a bottom end thereof to said second control valve;

a second manually activated lever for engaging said second push rod;

a second yoke pivotally attached at a top end thereof to a bottom end of said second manually activated lever and at a bottom end thereof to a top end of said second push rod;

a second rocker arm attached at a first end to a middle portion of said second yoke;

a second cam attached to said cam shaft so as to rotate said second cam about a second axis of rotation of said second cam;

a first arm portion attached at a first end thereof to a second end of said rocker arm;

a second rocker arm pivot located between said first and second ends of said second rocker arm;

a second roller and a third roller, each attached at opposite ends of a cross bar located above said second cam and attached at a midsection thereof to a second end of said first arm portion;

a second arm portion attached at a first end thereof to said second end of said rocker arm; and a fourth roller attached at a second end of said second arm portion located below said second cam, wherein, during said first portion of each predetermined cycle, an engaging portion of said second cam located at a region furthest on said second cam from said second axis of rotation pushes any one of said second and third rollers upwardly so as to push said cross bar upwardly, thereby pushing up on said first arm portion, forcing said second end of said rocker arm upwardly, causing said rocker arm to pivot about said second rocker arm pivot, forcing said first end of said second rocker arm and said second yoke downwardly, and forcing said second push rod downwardly so as to place said second control valve in said lowered state to provide hydraulic power to said packing cylinder so as to cause said tamping platen to move in said downwardly direction, and wherein, during said second portion of each predetermined cycle, said engaging portion of said second cam pushes said fourth roller downwardly, thereby pushing down on said second arm portion and said second end of said second rocker arm, causing said second rocker arm to pivot about said second rocker arm pivot, forcing said first end of said second rocker arm and said second yoke upwardly, and forcing said second push rod upwardly so as to place said second control valve in said raised state to provide hydraulic power to said packing cylinder to cause said tamping platen to move in said downward direction.

5. A cotton module builder as claimed in claim 1, further comprising:

first end detection means for indicating the presence of said tamping means within a first predetermined distance of said first end of said bin;

means for adjusting said predetermined mode so as to be set to said reverse mode in response to the detection of a location of said tamping means within said first predetermined distance of said first end of said bin as determined by said first end detection means;

second end detection means for indicating the presence of said tamping means within said first predetermined distance of said second end of said bin; and means for adjusting said predetermined mode so as to be set to said forward mode in response to the detection of a location of said tamping means within said first predetermined distance of said second end of said bin as determined by said second end detection means.

6. A cotton module builder as claimed in claim 5, further comprising:

first proximity end detection means for indicating the presence of said tamping means within a second predetermined distance of said first end of said bin, said second predetermined distance being greater than said first predetermined distance;

second proximity end detection means for indicating the presence of said tamping means within said second predetermined distance of said second end of said bin;

speed reducing means for retarding said horizontal drive means so as to slow down the horizontal movement of said tamping means in response to the detection of a location of said tamping means within said second predetermined distance of selectively one of said first end and said second end of said bin as determined by said first proximity end detection means and said second proximity end detection means, respectively; and, speed acceleration means for powering said horizontal drive means so as to move said tamping means at a predetermined normal rate of movement in response to the detection of a location of said tamping means greater than said second predetermined distance of both said first end and said second end of said bin as determined by said first proximity end detection means and said second proximity end detection means.

7. An automatic controller connectable to a cotton module builder, said cotton module builder having a bin for containing cotton deposited through a top open end thereof, said cotton module builder also including a tamping means mounted on said top open end for performing a tamping function by compacting cotton contained within said bin, said tamping means including a tamping platen for performing said tamping function and a vertical drive means for selectively moving said tamping platen in a downward direction toward any cotton contained in said bin and in an upward direction away from any cotton contained in said bin, said cotton module builder further including a horizontal drive means for allowing said tamping means to move horizontally along said top open end of said bin when activated in a predetermined mode, said predetermined mode selectively adjustable between a forward mode for moving said tamping means in a first horizontal direction toward a first end of said bin and a reverse mode for moving said tamping means in a second horizontal direction opposite said first horizontal direction toward a second end of said bin opposite said first end of said bin, said cotton module builder further including a manually activated controller including means for manually controlling said vertical drive means and said horizontal drive means by a human operator, said automatic controller comprising means for continuously operating said vertical drive means and said horizontal drive means in predetermined cycles, said automatic controller further comprising:

vertical drive actuation means for activating said vertical drive means so as to move said tamping platen in said upward direction for a first portion of each of said predetermined cycles and in said downward direction for a second portion of each of said predetermined cycles; and horizontal drive actuation means for activating said horizontal drive means in said predetermined mode for an overlap portion located about a transition between said first portion and said second portion of each predetermined cycle.

8. An automatic controller as claimed in claim 7, further comprising:

first end detection means for indicating the presence of said tamping means within a first predetermined distance of said first end of said bin;

means for adjusting said predetermined mode so as to be set to said reverse mode in response to the detection of a location of said tamping means within said first predetermined distance of said first end of said bin as determined by said first end detection means;

second end detection means for indicating the presence of said tamping means within said first predetermined distance of said second end of said bin; and means for adjusting said predetermined mode so as to be set to said forward mode in response to the detection of a location of said tamping means within said first predetermined distance of said second end of said bin as determined by said second end detection means.

9. An automatic controller as claimed in claim 8, further comprising:

first proximity end detection means for indicating the presence of said tamping means within a second predetermined distance of said first end of said bin, said second predetermined distance being greater than said first predetermined distance;

second proximity end detection means for indicating the presence of said tamping means within said second predetermined distance of said second end of said bin;

speed reducing means for retarding said horizontal drive means so as to slow down the horizontal movement of said tamping means in response to the detection of a location of said tamping means within said second predetermined distance of selectively one of said first end and said second end of said bin as determined by said first proximity end detection means and said second proximity end detection means, respectively; and, speed acceleration means for powering said horizontal drive means so as to move said tamping means at a predetermined normal rate of movement in response to the detection of a location of said tamping means greater than said second predetermined distance of both said first end and said second end of said bin as determined by said first proximity end detection means and said second proximity end detection means.

10. An automatic controller as claimed in claim 7, wherein said horizontal drive means includes a hydraulic traversing motor, said horizontal drive actuation means comprising:

a first control valve for providing hydraulic power to said hydraulic traversing motor thereby activating said horizontal drive means in said predetermined mode when said first control valve is placed in a lowered state, said first control valve preventing said tamping means from moving horizontally when placed in a neutral state;

a first push rod pivotally attached at a bottom end thereof to said first control valve;

a first manually activated lever for engaging said first push rod;

a first yoke pivotally attached at a top end thereof to a bottom end of said first manually activated lever and at a bottom end thereof to a top end of said first push rod;

a first rocker arm attached at a first end to a middle portion of said first yoke;

a first cam;

a first roller located above said first cam and attached at a second end of said first rocker arm;

a first rocker arm pivot located between said first and second ends of said first rocker arm;

a cam shaft connected to said first cam so as to rotate said first cam about a first axis of rotation of said first cam; and a motor for driving said cam shaft in a rotary direction at a predetermined angular velocity, wherein an engaging portion of said first cam located at a region furthest from said first axis of rotation pushes said first roller upwardly during said portion of each predetermined cycle so as to push said second end of said first rocker arm upwardly, thereby rotating said first rocker arm about said first rocker arm pivot so as to push said second end of said first rocker arm down, pushing said first yoke down so as to push said first push rod down, and placing said first control valve in said lowered state, thereby activating said horizontal drive means in said predetermined state.

11. An automatic controller as claimed in claim 7, wherein said vertical drive means includes a hydraulic packing cylinder, said vertical drive actuation means comprising:

a second control valve for providing hydraulic power in a lowered state to said packing cylinder, thereby causing said tamping platen to move in said downward direction, said second control valve causing said tamping platen to move in said upward direction when placed in a raised state, and preventing said tamping platen from moving vertically when placed in a neutral state;

a second push rod pivotally attached at a bottom end thereof to said second control valve;

a second manually activated lever for engaging said second push rod;

a second yoke pivotally attached at a top end thereof to a bottom end of said second manually activated lever and at a bottom end thereof to a top end of said second push rod;

a second rocker arm attached at a first end to a middle portion of said second yoke;

a first arm portion attached at a first end thereof to a second end of said rocker arm;

a second rocker arm pivot located between said first and second ends of said second rocker arm;

a second and third roller, each attached at opposite ends of a cross bar located above said second cam and attached at a midsection thereof to a second end of said first arm portion;

a second arm portion attached at a first end thereof to said second end of said rocker arm; and a fourth roller attached at a second end of said second arm portion located below said second cam, wherein, during said first portion of each predetermined cycle, an engaging portion of said second cam located at a region furthest on said second cam from said second axis of rotation pushes said second and third rollers upwardly so as to push said cross bar upwardly, thereby pushing up on said first arm portion, forcing said second end of said rocker arm upwardly, causing said rocker arm to pivot about said second rocker arm pivot, forcing said first end of said second rocker arm and said second yoke downwardly, forcing said second push rod downwardly so at to place said second control valve in said lowered state to provide hydraulic power to said packing cylinder so as to cause said tamping platen to move in said downward direction, and wherein, during said second portion of each predetermined cycle, said engaging portion of said second cam pushes said fourth roller downwardly, thereby pushing down on said second arm portion and said second end of said second rocker arm, causing said second rocker arm to pivot about said second rocker arm pivot, forcing said first end of said second rocker arm and said second yoke upwardly, forcing said second push rod upwardly so as to place said second control valve in said raised state to provide hydraulic power to said packing cylinder and, causing said tamping platen to move in said upward direction.

* * * * *